United States Patent [19]

Lorenz et al.

[11] Patent Number: 4,559,424

[45] Date of Patent: Dec. 17, 1985

[54] DISCONNECT SWITCH FOR HIGH-VOLTAGE SWITCHING INSTALLATION

[75] Inventors: Dieter Lorenz; Willi Olsen, both of Berlin, Fed. Rep. of Germany

[73] Assignee: Siemens Aktiengesellschaft, Munich, Fed. Rep. of Germany

[21] Appl. No.: 640,997

[22] Filed: Aug. 15, 1984

[30] Foreign Application Priority Data

Aug. 15, 1983 [DE] Fed. Rep. of Germany ..... 3329555

[51] Int. Cl.[4] ..... H01H 33/12

[52] U.S. Cl. ..... 200/146 R; 200/148 B; 200/148 F

[58] Field of Search ..... 200/148 F, 146 R, 148 B, 200/148 R

[56] References Cited

U.S. PATENT DOCUMENTS 4,365,126 12/1982 Oshima et al. ..... 200/148 F 4,445,014 4/1984 Gruner et al. ..... 200/146 R

*Primary Examiner*—Robert S. Macon

*Attorney, Agent, or Firm*—Kenyon & Kenyon

[57] ABSTRACT

A switching assembly for a high voltage switching installation includes a tubular movable main switching contact in which is disposed an auxiliary switching pin. An elastic spring drive with a drive lever and a cocking lever is pivotably attached at an outer part of a shaft traversing the movable main switching contact. The drive lever is connected at an end opposite the pivot shaft to one end of a coupling lever in turn pivotably connected at an end to the auxiliary switching pin by means of a shaft. A hinged spring is connected at one end to the drive lever and at an opposite end to the cocking lever. A guide roller of a mechanical control is rotatably secured to the cocking lever and is disposed in a longitudinal guide slot for controlling the cocking of the spring to shift the drive lever between two end positions.

9 Claims, 14 Drawing Figures

DISCONNECT SWITCH FOR HIGH-VOLTAGE SWITCHING INSTALLATION

BACKGROUND OF THE INVENTION

This invention relates to a switch assembly for use in high-voltage switching installations and, more particularly, in switching installations which are encapsulated in metal casings and insulated by means of compressed gas.

As described in U.S. Pat. No. 4,445,014, a disconnect switch for metal-encapsulated high-voltage switching installations, particularly installations insulated by means of compressed gas such as $SF_6$, has a switching gap disposed between a pair of field electrodes. A tubular fixed contact is disposed in one of the field electrodes, while a tubular movable contact or main switching pin is disposed in the other of the field electrodes. The movable contact contains a spring loaded auxiliary switching pin which is engageable with a respective mating contact located in the fixed contact of the disconnect switch. The movable contact of the disconnect switch is operatively linked to a relatively slow drive, the auxiliary switching pin being provided in order to short the switching gap during a disconnecting operation. The auxiliary switching pin remains engaged with its mating contact until the movable main switching pin has reached a position at a distance from the fixed contact at least equal to the voltage breakdown limit of the insulating gas.

In the disconnect switch assembly described in U.S. Pat. No. 4,445,014, the fixed contact contains a mechanical control including stops and a ratchet which prevents the disengagement of the auxiliary switching pin and its mating contact until the main movable contact has reached the voltage breakdown position. Upon the release of the auxiliary switching pin from its mating contact in response to a triggering action by the mechanical control in the fixed contact, the auxiliary switching pin is returned by its loaded spring into the tubular movable contact with a speed greater than the motion thereof. Any low-current arc generated during the disconnecting operation is quickly interrupted owing to the high speed with which the auxiliary switching pin is separated from the ratchet. The speed of withdrawal of the auxiliary switching pin prevents an electrical arc from having sufficient time to travel to the grounded metal encapsulation and thereby to initiate a short to ground. Because the auxiliary switching pin and its mating contact are located in the "off" position in the interiors of the field electrodes, the electric field in the switching gap is not effected by their presence. During a circuit closing operation, the auxiliary switching pin is entrained or shifted along with the movable main switching contact until the pin has reached its mating contact and interlocks therewith.

The use of the above-described mechanical control including stops and a ratchet for preventing the withdrawal of the auxiliary switching pin until a predetermined position has been reached by the tubular movable contact has the disadvantage that extremely high specific pressures are necessary for locking the ratchet to the auxiliary switching pin, these pressures being requlred because of the large spring forces used for accelerating the auxiliary switching pin. The existence of such high pressures in the disconnect device results in a wear of the part.

U.S. Pat. No. 4,451,716 describes an elastic spring drive for shifting the movable switching pin of a disconnect switch. The elastic spring drive includes a cocking lever rotatably supported by a drive shaft and a drive lever rigidly contacted to the drive shaft. The free end of the drive lever is pivotably connected to one end of an elastic compression spring, the other end of which spring is pivotably connected to the free end of the cocking lever. The cocking lever is connected to an actuating lever movable in the direction of its longitudinal axis.

An object of the present invention is to provide an improved switching assembly for use in metal-encapsulated high-voltage switching installations filled with compressed insulating gas.

A more particular object of the present invention is to provide such a switching assembly with a control triggering mechanism for the faster movement of the auxiliary switching pin in respect of the movable main switching pin, which trigger mechanism is as free from wear and tear as possible and, in addition, becomes effective in a specific position not only during the switching-on process, but also during the switching-off process.

SUMMARY OF THE INVENTION

The present invention is directed to providing a switch assembly for use in a metal-encapsulated switching installation filled with compressed insulating gas and having a pair of hollow electrodes spaced from one another by an isolating space. The switching assembly comprises, in accordance with the invention, a tubular fixed contact disposed in one of the hollow electrodes and a tubular movable main switching contact disposed in the other of the hollow electrodes. The movable contact is shiftably mounted to bridge the isolating space and electrically engage the fixed contact. A drive or motor means is operatively linked to the movable main switching contact for shifting the contact alternately toward and away from the fixed contact. An auxiliary switching pin is shiftably mounted inside the movable main switching contact, the auxiliary switching pin being couplable to a mating contact inside the hollow electrode of the fixed contact for forming an electrically conductive connection to the mating contact by a movement faster than the movement of the main switching contact. A first shaft is mounted to the movable main switching contact and extends outwardly thereof. On an outer part of this first shaft is pivotally mounted an elastic spring drive for the auxiliary switching pin.

The elastic spring drive comprises a drive lever and a cocking lever, which are connected by a hinged spring pivotably coupled at one end to the drive lever and at an opposite end to the cocking lever for pivoting, in a snapping motion, the drive lever from one end position to the other upon the attainment of a first position by the movable main switching contact during a shifting thereof by the motor means towards the fixed contact. The spring also operates to snappingly pivot the drive lever from one end position to the other upon the attainment of a second position by the movable main switching contact during a shifting thereof by the motor means away from the fixed contact. A guide roller is connected to the cocking lever, which, controlled mechanically by cocking means, effects the respective loading of the hinged spring during the shifting of the movable main switching contact by the drive or motor means. At least one arrest is engageable with the drive lever for limiting the angular motion thereof to angular end positions and for holding the drive lever alternately in one of these two end positions, corresponding to the switch-on and switch-off positions of the movable main switching contact, against the action of the spring.

A third coupling lever couples pivotably the drive lever to the auxiliary switching pin and is mounted on a second shaft connected to the auxiliary switching pin. The shaft is guided in slots of the movable main swithcing contact.

In a switch assembly in accordance wih the present invention, the mechanical control of the guide roller attached the cocking lever depends, among other things, on the motion of the movable main switching contact. During a shifting of the movable main switching contact toward or away from the fixed contact of the disconnect switch, the guide roller is mechanically controlled to move in such a way that the spring is loaded while the spring holds the drive lever in one of two end positions corresponding to the on or off position of the movable main switching contact. The maximum loading of the spring is attained when the drive and cocking levers are juxtaposed to one another along their respective lengths, i.e., when the levers are parallel to one another. Upon a first rotation of the drive lever in response to further motion of the main contact, the spring is released from its loaded state and pushes the drive lever in a snap-like action in a direction opposed to that of the cocking lever. Thus, the drive lever is quickly shifted from one of its end positions to the other and the auxiliary switching pin is accelerated relative to the movable contact via the coupling lever.

In a switch assembly in accordance with the present invention, the contact end of the auxiliary switching pin is advantageously disposed, in one end position or "switched off" state of the switch assembly, at a distance from the contacting end of the tubular movable main switching contact. The spacing of the contact end of the auxiliary switching pin from the contact end of the movable main switching contact enables the auxiliary switching pin to be accelerated to a high speed by the snapping action of the lever and spring assembly prior to the emergence of the auxiliary switching pin from the opening or mouth of the movable main contact. When the remaining isolating space, which is bridged during the switch-on movement or the switching-off process by the auxiliary switching pin at a speed which is essentially higher than that of the movable main switching contact which is driven slowly, equals an isolating space which corresponds to the electric strength, there is the advantage that a preliminary arc discharge or switch-off arc, which might develop, does not have the time required in order to be able to drift to the encapsulation and initiate an earth short circuit before it ceases to exist.

In a switch assembly in accordance with the present invention, the auxiliary switching pin does not move relative to the main contact while the spring of the elastic spring drive is being cocked. The advantage is thereby obtained that the start of the motion is unambiguously coupled to a definite position of the movable main contact, which position is freely selectable in accordance with the type of mechanical control.

The spring of the elastic spring drive for the auxiliary switching pin can be realized as either a compression or a tension spring. The space required for the elastic spring drive is smaller if a tension spring is used.

Pursuant to a particular feature of the present invention, the drive lever, the cocking lever, the coupling lever, the spring, the guide member and guide slot comprise components of a first elastic spring drive disposed on a side of the movable contact. A second elastic spring drive having components substantially identical to the components of the first elastic spring drive is disposed on the other side of the movable contact substantially opposite the first elastic spring drive. In the symmetrical or mirror-like design, the longitudinal axis of the movable main contact constitutes an axis of symmetry. The symmetrical design about the axis of the main contact results in a smaller stress on the support points of the levers and pivot pins. Moreover, a stiffening or support of the drive assembly for the auxiliary switching pin can be achieved by designing at least one of the levers, e.g., the cocking levers of each spring drive, in the form of a fork or yoke extending between the first and second spring drives. In addition, the use of two loading springs results in an increase in the total energy available for accelerating the auxiliary switching pin, whereby larger velocities can be achieved.

The maximally loaded state of the spring or springs in the elastic spring drive is advantageously reached when the contact end of the movable main switching contact is within the switching gap and at a distance from the fixed contact corresponding to the necessary voltage breakdown strength, i.e., at a distance from the fixed contact at which the resistance of the compressed insulating gas does not yet break down under the voltage between the contacts. In this case, while the auxiliary switching pin is still located in the interior of the movable main contact, a closing arc cannot generated and an opening arc cannot continue to burn.

Pursuant to a particular feature of the present invention, a simple construction of the mechanical control is obtained if the guide or cocking means contains a guide slot in which a pair of pivotably mounted guide levers are disposed for controlling the motion of the guide member and the second lever to thereby load the spring. The guide levers are substantially identical in form and are arranged in a mirrored configuration. Stops are provided in the guide slot for arresting the pivotal motion of the guide levers. The guide levers serve to deflect the guide member in a direction perpendicular to the translation of the movable main contact, thereby causing cocking of the spring of the elastic spring drive. Preferably, the guide levers are held against the respective stops by respective biasing springs so that the guide levers are effective independently of the position of the disconnect switch.

In accordance with a feature of the present invention, a disconnect switch for metal-encapsulated high-voltage switching systems having compressed insulating gas may contain two or more isolating spaces or switching gaps connected in series. In this case the elastic spring drive for the auxiliary switching pin is arranged at each movable main switching contact of each switching gap.

DETAILED DESCRIPTION

Figure 1:
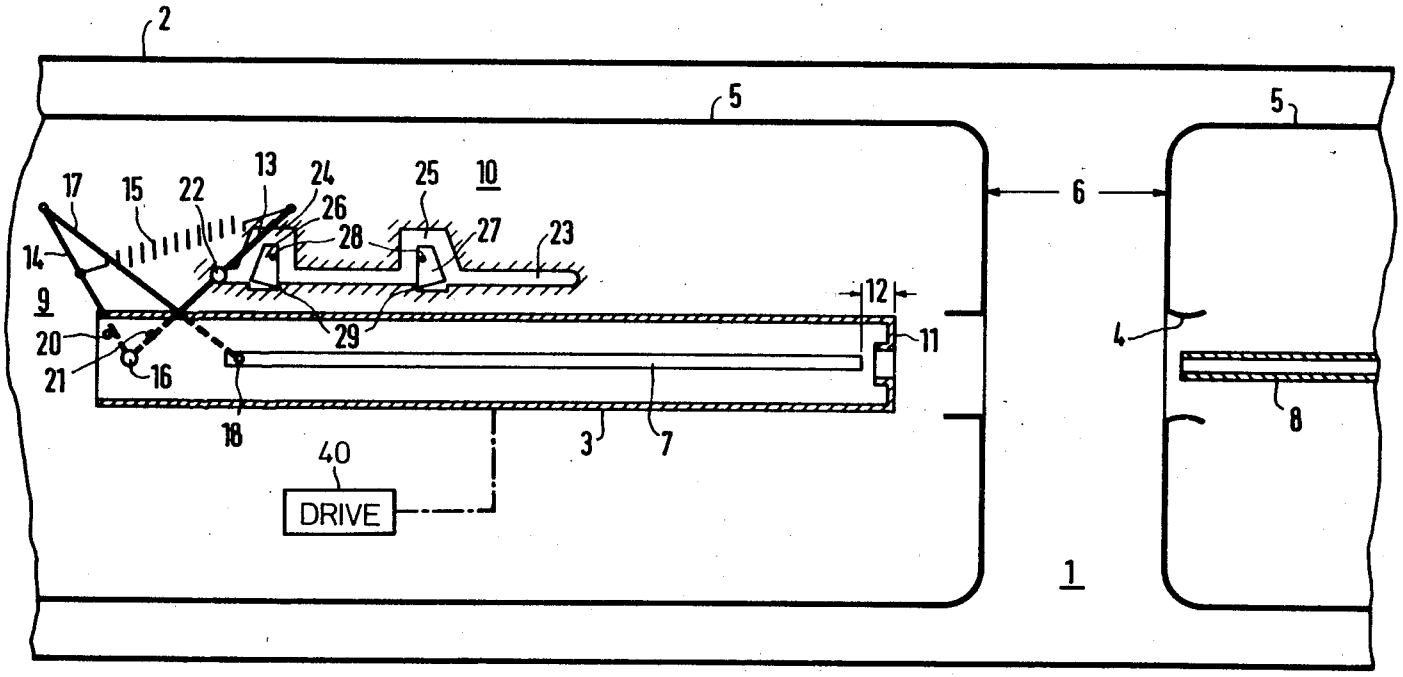
FIG. 1 is a partially schematic longitudinal cross-sectional view of a switching assembly in accordance with the present invention, showing a movable main switching contact, an auxiliary switching pin and an elastic spring drive connected thereto.

As illustrated in FIG. 1, a disconnect switch 1 is installed in a tubular metallic grounded encapsulation 2 which is filled with compressed insulating gas, preferably $SF_6$. In order to equalize the electric field between the metallic encapsulation 2 and a tubular movable main switching contact 3 and a likewise tubular fixed main switching contact 4, the switching contacts 3 and 4 are surrounded by respective shielding field electrodes 5. The distance between the hollow field electrodes 5 and encapsulation 2 is not shown to scale in the drawing.

An auxiliary switching pin 7 is disposed in the interior of tubular movable main contact 3, while a mating contact 8 is disposed in the field electrode 5 of the fixed contact 4. In the "off" position of the switch assembly 1 shown in FIGS. 1 and 4, auxiliary switching pin 7 is located inside movable main contct 3 and is set back relative to the end face 11 of contact 3 by a distance 12.

The switch assembly is provided with a drive or motor means 40 operatively connected to the movable main contact 3 for alternately shifting the same toward and away from the fixed main contact 4. The motion of movable main contact 3 under the control of drive 40 is relatively slow.

The auxiliary switching pin 7 has an elastic spring drive 9 operatively connected to a mechanical control 10. Mechanical control 10 includes a guide slot 23 and guide levers 26 and 27 firmly attached to the interior of the field electrode 5 associated with movable contact 3. Elastic spring drive 9 comprises a cocking lever 13 and a driving lever 14, a compression spring 15 being connected at one end to cocking lever 13 and at an opposite end to drive lever 14. Both levers 13 and 14 are disposed on one side of main contact or switching pin 3 and are swingably attached at one end to a shaft or pivot pin 16 which traverses movable main contact 3. The other end of drive lever 14 is pivotably connected to a coupling lever 17 in turn connected by means of a support shaft or pivot pin 18 to auxiliary switching pin 7. Support shaft 18 is guided in lateral slots 19 of the movable main contact 3.

Attached to the outside surface of movable main contact or switching pin 3 are two stops or arrests 20 and 21 (indicated as circles in FIG. 1) which serve to limit the angular motion of drive lever 1 between an unactuated first end position corresponding to an off-state of the switch assembly (see FIG. 1) and an actuated second end position corresponding to an on-state of the switch assembly (see FIGS. 7–11).

Spring 15 holds drive lever 14 during the entire switching motion in one of the two end positions determined by stops 20 and 21.

Figure 3:
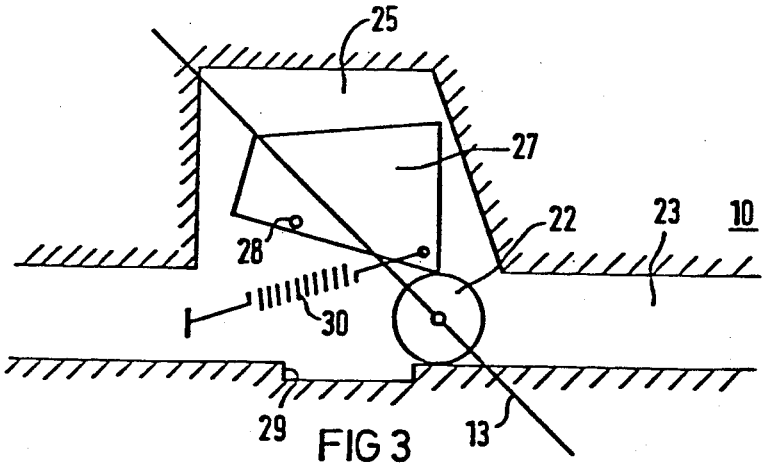
FIG. 3 is a partially schematic side view of a portion of the elastic spring drive illustrated in FIGS. 1 and 2.

A guide roller 22 is rotatably mounted to cocking lever 13 and is disposed in guide slot 23 of mechanical control 10. Slot 23 extends longitudinally, i.e., substantially parallel to auxiliary switching pin 7. On the top side of slot 23 are provided a pair of recesses 24 and 25 in which respective guide levers 26 and 27 are rotatably arranged about respective pivots 28. The lower tips of guide levers 26 and 27 are engageable with respective stops 29 located below the pivot points 28 in downwardly extending recesses of the guide slot 23. Each guide lever 26 and 27 is provided with a respective tension spring 38 which holds the guide lever against the respective stop 29. Guide levers 26 and 27 are substantially identical in structure and are arranged with mirror symmetry about their respective pivots 28 and their stops 29 (see FIG. 3).

Figure 4:
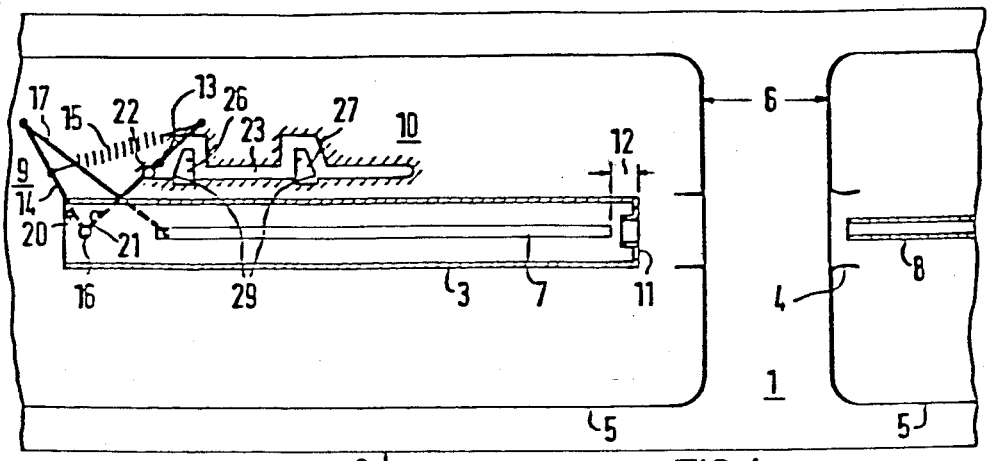
FIGS. 4–12 are partially schematic longitudinal cross-sectional views similar to FIG. 1, on a reduced scale, showing successive stages in the operation of the switch assembly of FIG. 1.

As illustrated in FIG. 4, in the off position of the switch assembly 1 auxiliary switching pin 7 is located inside movable main switching contact 3. The forward end of auxiliary switching pin 7 is spaced from the forward end 11 of main contact 3. Drive lever 14 is supported on shaft or pivot pin 16 and is held in an unactuated position, determined by stop 20, by compression spring 15. Guide roller 22 engages the left end of guide slot 23 while guide levers 26 and 27 of mechanical control 10 bear against respective stops 29.

Upon the shifting of main contact 3 by drive 40 towards fixed contact 4 and mating contact 8, guide roller 22 slides along slot 23 until the guide roller engages guide lever 26. The forward motion of the guide roller along guide slot 23 is then arrested by guide lever 26, the guide roller being constrained to move upwardly into recess 24 until it reaches the position illustrated in FIG. 5. Spring 15 is compressed by lever 13.

Figure 5:
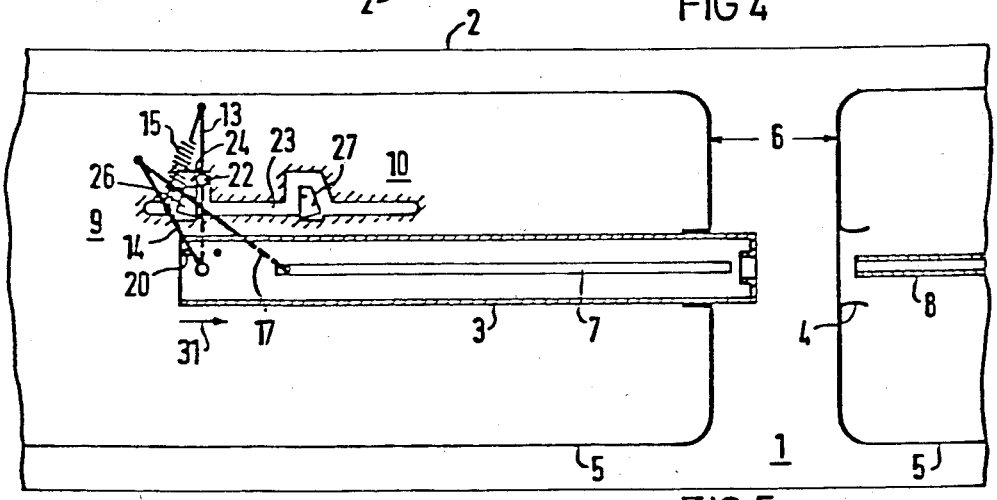
Figure 6:
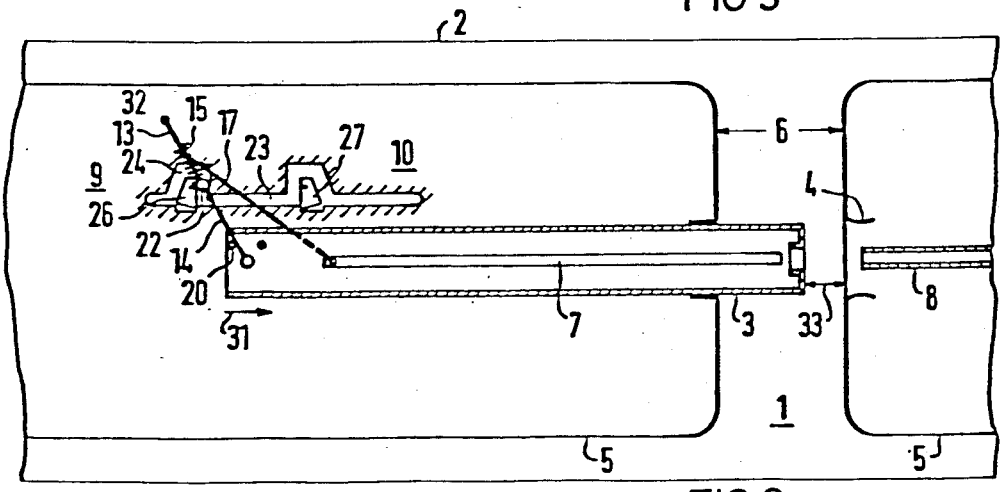

As movable main contact 3 continues its motion in the direction of an arrow 31 from the position shown in FIG. 5 to the position shown in FIG. 6, compression spring 15 is cocked. The configuration of the elastic spring drive 9 shown in FIG. 6 represents a maximally compressed state of spring 15.

It is to be noted that at the state of the switch assembly shown in FIG. 6 the forward end of movable main contact 3 has entered isolating space or switching gap 6. During the first portion of a connecting operation, represented by FIGS. 4–6, drive lever 14 remains in the unactuated position determined by stop 20 while auxiliary switching pin 7 remains completely surrounded by main contact 3. In the state of the switch assembly shown in FIG. 6, levers 13 and 14 are juxtaposed to one another along their respective lengths. Guide roller 22 is located at the upper right corner of recess 24 and is, therefore, already located on the backside of guide lever 26. The forward face 11 of main contact 3 is disposed at a distance 33 from the field electrode 5 associated with fixed main contact 4, this distance 33 corresponding to the required voltage breakdown strength, i.e., to the voltage between the main contacts 3 and 4 at which the resistance of the compressed insulating gas breaks down.

Figure 7:
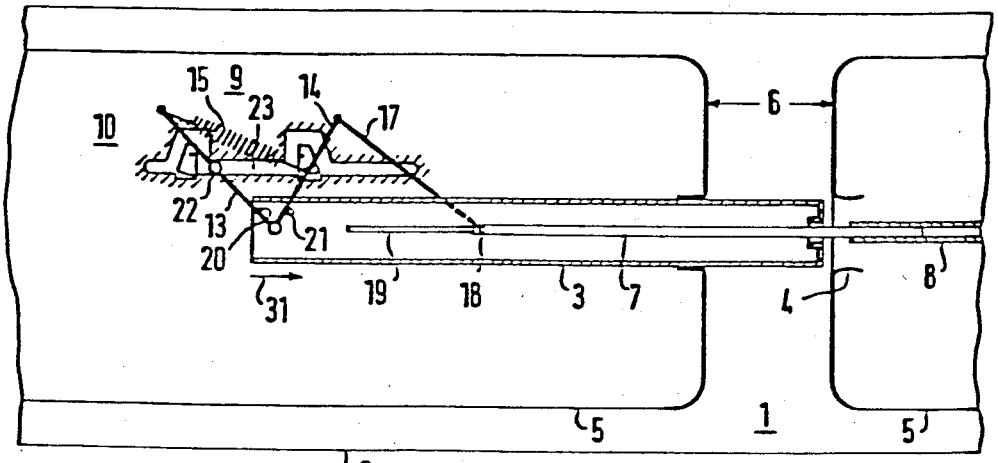

Upon further motion of movable main contact 3 towards fixed contact 4, spring 15 is released from its fully compressed state and rapidly snaps drive lever 14 and coupling lever 17, as well as auxiliary switching pin 7, in the direction of arrow 31. The loading of spring 15 and the subsequent release thereof effectuates a rapid pivoting of drive lever 14 about shaft 16 from the unactuated first end position determined by stop 20 to the actuated second end position determined by stop 21. The disposition of drive lever 14 in its actuated position and the concomitant position of cocking lever 13 and coupling lever 17 are illustrated in FIG. 7.

Upon the release of spring 15 from the maximally compressed state thereof shown in FIG. 6, auxiliary switching pin 7 accelerates from a zero velocity relative to movable contact 3 to a high speed relative thereto during the traversal of the distance 12 (see FIG. 1) by the leading end of the auxiliary switching pin 7. The pin then bridges rapidly the remaining distance between movable main contact 3 and fixed main contact 4 and establishes a conductive connection with mating contact 8 so that both field electrodes 5 are at the same potential. A possibly occurring predischarge arc cannot travel towards metal encapsulation 2 because of the high speed of auxiliary switching pin 7.

Figure 8:
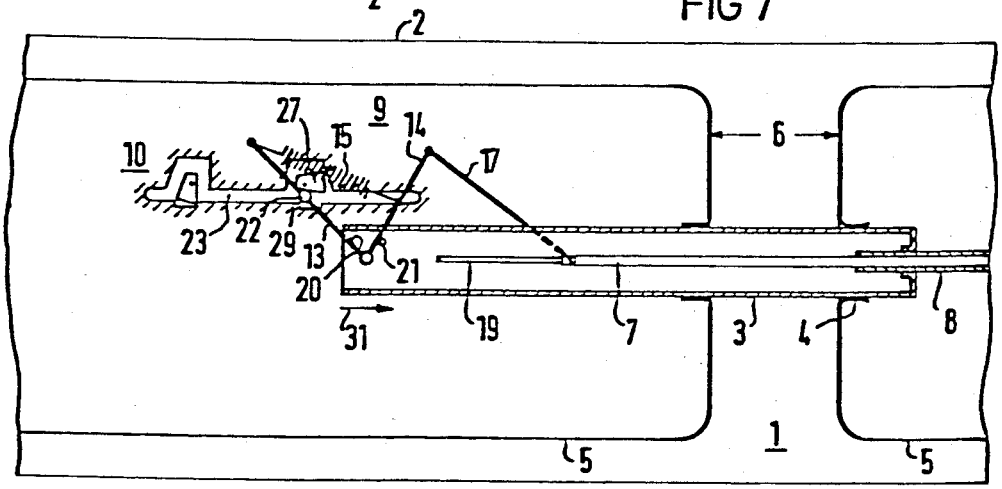

During further motion of main contact 3 in the direction of arrow 31, roller 22 travels along slot 33 from guide lever 26 toward guide lever 27. During a final phase of the connecting stroke of movable main contact 3, roller 22 engages a rearward facing surface of guide lever 27 and pivots the same around the respective pivot point 28, as illustrated in FIG. 8. It is to be noted that the relative positions of auxiliary switching pin 7 and movable main contact 3 do not change upon the attainment by drive lever 14 of its actuated position.

Figure 9:
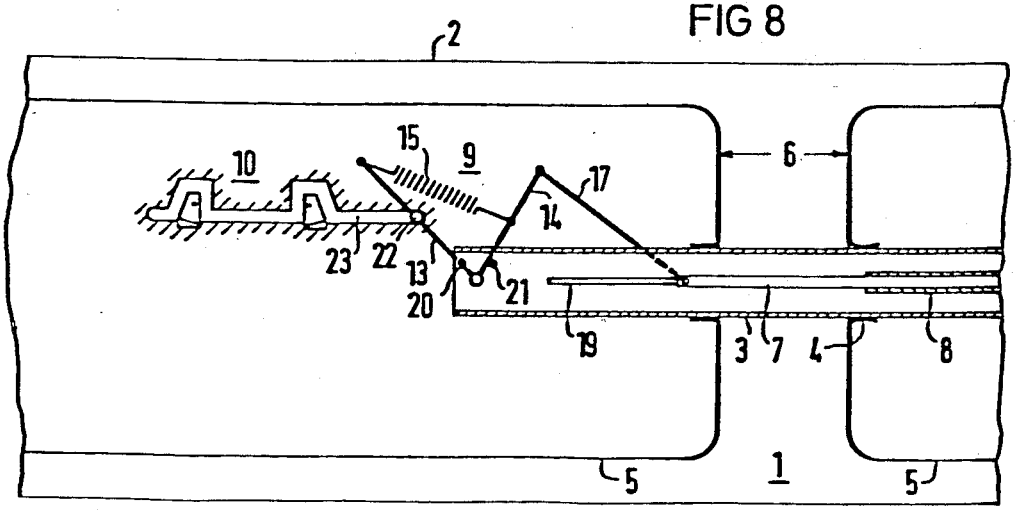

FIG. 9 illustrates the fully connected state of the switch assembly 1. In this state roller 22 is located at the far right end of slot 23.

Figure 10:
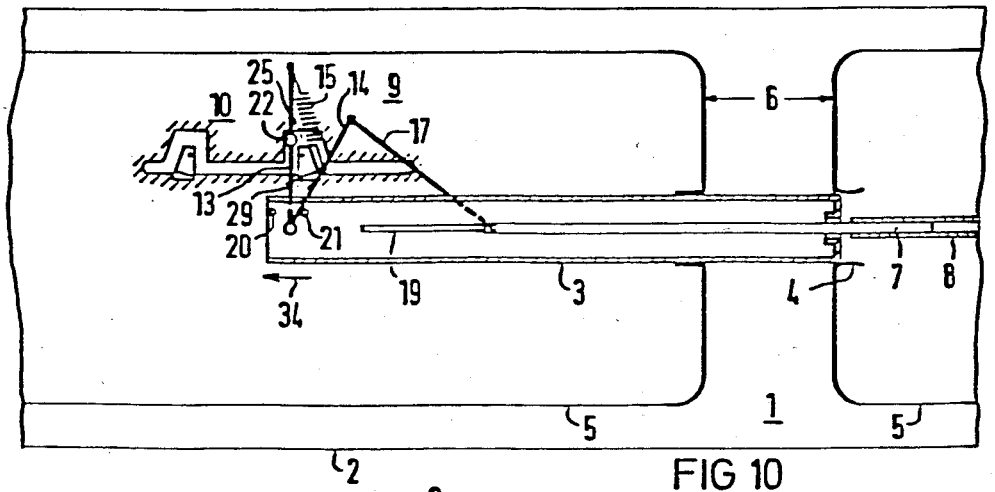
Figure 11:
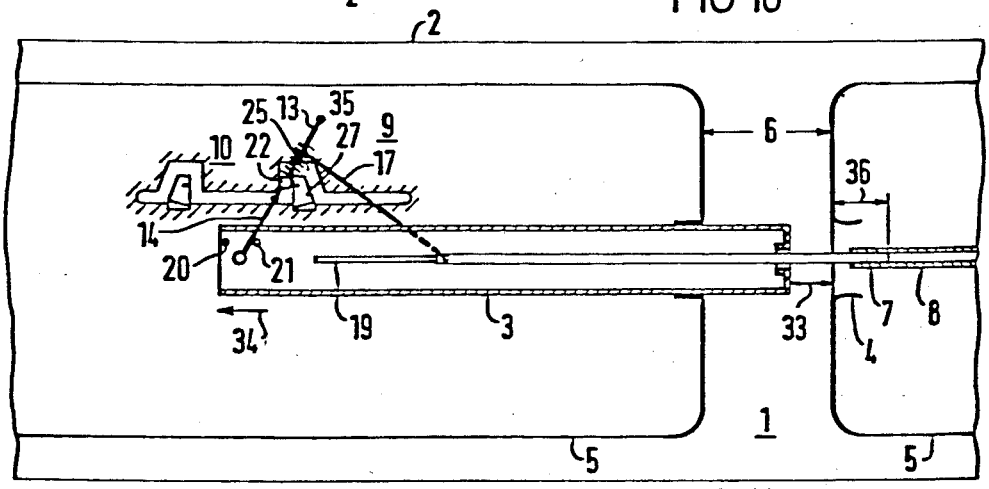
Figure 12:
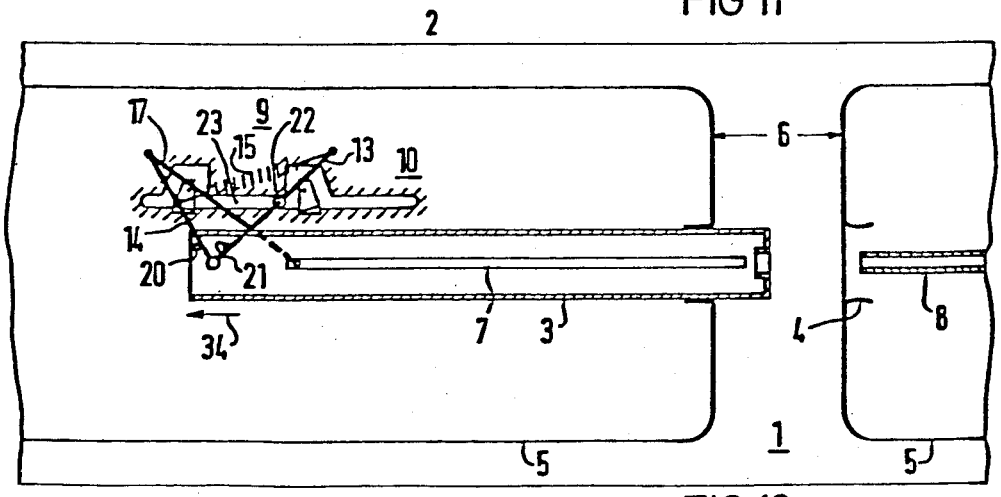

FIGS. 10–12 illustrate successive stages during a disconnecting operation or withdrawal stroke of main contact 3. Upon a shifting of movable main contact 3 in the direction of an arrow 34 away from main contact 4 and mating contact 8, roller 22 is blocked in its longitudinal motion along guide slot 23 by guide lever 27 and is forced thereby upwardly into recess 25. Upon the attainment by roller 22 of the position shown in FIG. 10, the drive lever 14 is in its second end position. The motion of lever 14 causes compression string 15 to become increasingly compressed.

FIG. 11 shows a state of the elastic spring drive 9 in which spring 15 has attained a maximally compressed state. In this state of spring 15 levers 13 and 14 are parallel to one another and guide roller 22 is located along the substantially transversely oriented backside of guide lever 27. Movable main contact 3 has attained a position at which the forward face 11 of the contact is spaced from fixed contact 4 by a distance 33 corresponding to the voltage across contacts 3 and 4 at which the compressed insulating gas breaks down. Auxiliary switching pin extends inwardly into the field electrode 5 associated with fixed contact 4 by a distance 36. Distance 36 enables the acceleration of the auxiliary switching pin to a relatively high speed before the free end thereof passes out of the space enclosed by field electrode 5 associated with fixed contact 4.

Figure 2:
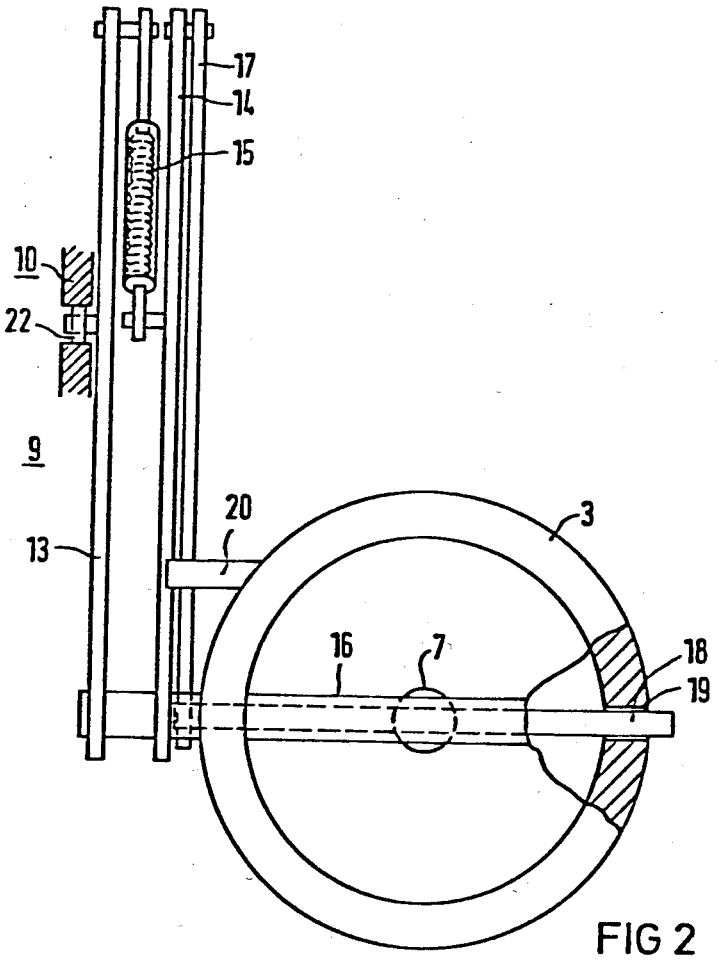
FIG. 2 is a front elevational view, partially in cross-section, of the movable main contact and elastic spring drive of FIG. 1.

Upon further motion of movable main contact 3 in the direction of arrow 34, spring 15 is released from its compressed state and rapidly pivots drive lever 14 about shaft 16 from the actuated position shown in FIG. 11 to the unactuated position shown in FIG. 12, thereby rapidly shifting auxiliary switching pin 7 in the direction of arrow 34 by means of coupling lever 17 and pivot shaft 18 (see FIG. 2).

Continued motion of movable contact 3 in the direction of arrow 34 under the control of drive 40 shifts elastic spring drive 9, as well as auxiliary switching pin 7, from the position illustrated in FIG. 12 to the position illustrated in FIG. 1.

Figure 13:
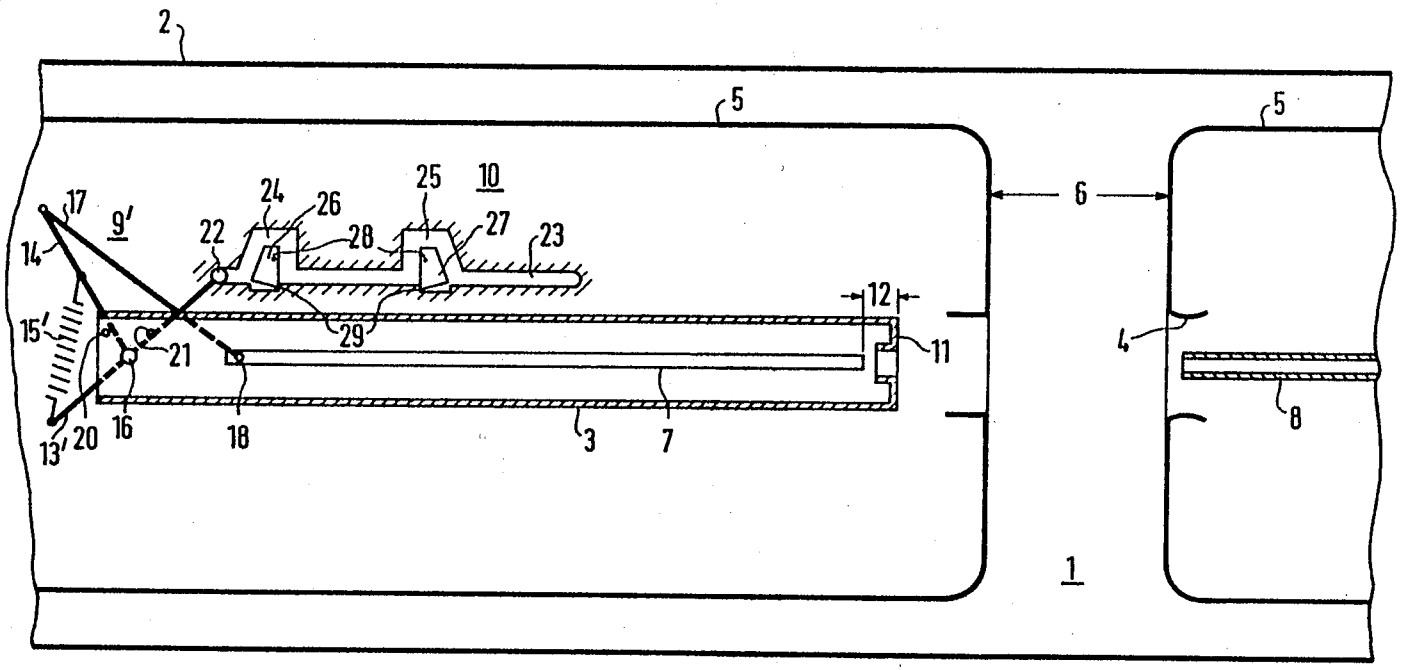
FIG. 13 is a partially schematic longitudinal cross-sectional view, similar to FIGS. 1 and 4–12, showing another embodiment of the elastic spring drive of FIG. 1.

As illustrated in FIG. 13, auxiliary pin 7 may be driven by an elastic spring drive 9' which includes a tension spring 15' connected at one end to drive lever 14 and at an opposite end to a cocking lever 13'. As heretofore described with respect to FIG. 1, drive lever 14 and cocking lever 13' are pivotably secured to main contact 3 at shaft 16. Roller 22 is rotatably attached to cocking lever 13' at an end thereof. Tension spring 15' is connected to cocking lever 13' at an end thereof opposite roller 22, cocking lever 13' extending on both sides of pivot pin or shaft 16. In view of the above description of the embodiment of FIG. 1, the operation of the embodiment of FIG. 13 will be clear to one skilled in the art.

Figure 14:
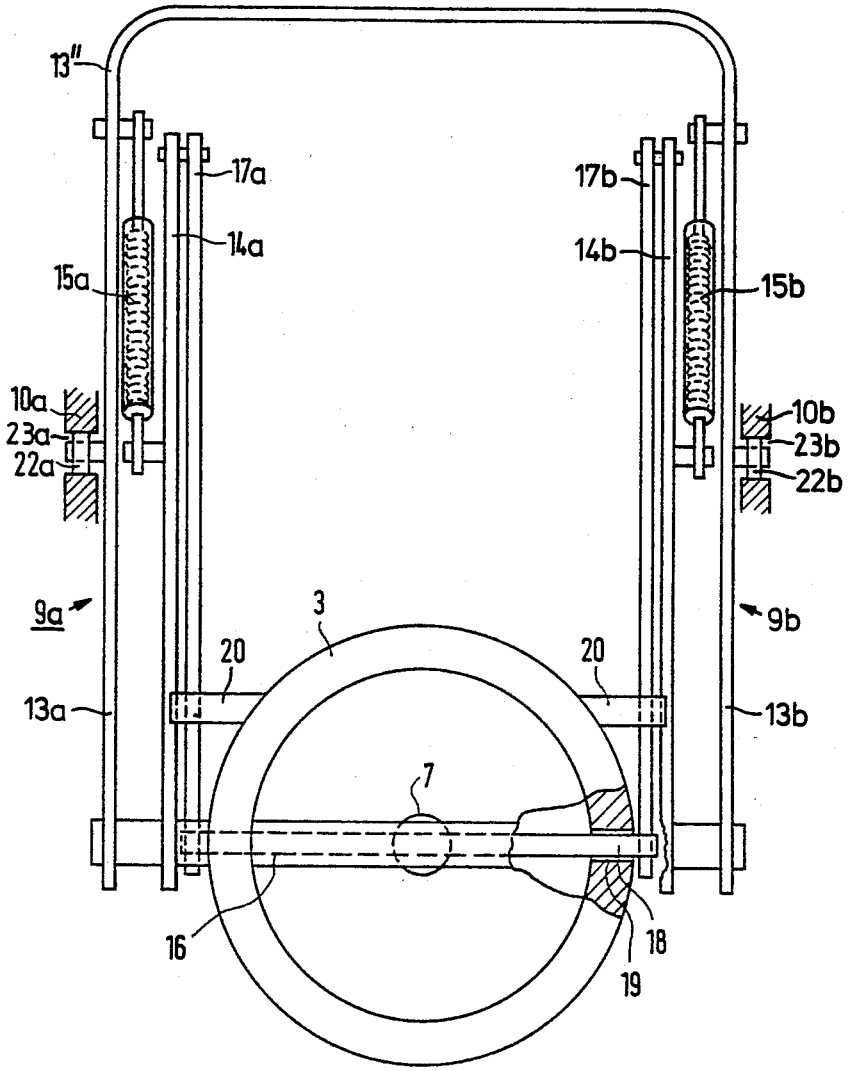
FIG. 14 is a front view, partially in cross-section of a movable main contact, showing a pair of elastic spring drives on opposite sides of the movable main contact.

As illustrated in FIG. 14, a pair of elastic spring drives **9*a* and 9*b* may be provided on opposite sides of movable main contact 3. Each elastic spring drive includes a respective drive lever 14*a* and 14*b* coupled to shaft 16 which traverses the movable main contact 3. At an end opposite shaft 16 each drive lever 14*a* and 14*b* is pivotably connected to an end of a respective coupling lever 17*a* and 17*b*. Each coupling lever 17*a* and 17*b* is turn connected at an opposite end to auxiliary switching pin 7 via shaft 18**.

Each elastic spring drive **9*a* and 9*b* includes a respective compression spring 15*a* and 15*b* pivotably connected at one end to an intermediate point along the respective drive lever 14*a* and 14*b* and at an opposite end to a yoke- or fork-shaped lever 13''. Fork-shaped member 13'' is connected at its free ends to shaft 16, while each arm or prong 13*a* and 13*b* of the fork is provided with a respective roller 22*a* and 22*b* disposed in a respective longitudinally extending slot 23*a* and 23*b* of a pair of mechanical controls 10*a* and 10*b***.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A switch assembly in a metal-encapsulated switching installation filled with compressed insulating gas and having a pair of hollow electrodes spaced from one another by an isolating space, said switch assembly comprising:

a tubular fixed contact disposed in one of the hollow electrodes;

a tubular movable main switching contact disposed in the other of said hollow electrodes, said movable contact being shiftably mounted to bridge the isolating space and electrically engage said fixed contact;

drive means operatively linked to said movable main switching contact for it alternately toward and away from said fixed contact;

a tubular mating contact disposed in said one of said hollow electrodes, said mating contact being at the same potential as said fixed contact;

an auxiliary switching pin movably mounted inside said movable main switching contact, said auxiliary switching pin being couplable to said mating contact for forming an electrically conductive connection thereto by movement faster than the movement of said movable main switching contact;

a first shaft mounted to the movable main switching contact, said shaft extending outwardly of said movable main switching contact;

an elastic spring drive for the auxiliary switching pin, said elastic spring drive being pivotably mounted on an outer part of the first shaft, the elastic spring drive comprising a first and a second lever which are connected by a hinged spring pivotably coupled at one end to said first lever and at an opposite end to said second lever;

a guide roller rotatably connected to the second lever, which roller is controlled mechanically by cocking means to effect the respective loading of the hinged spring;

arresting means for limiting the first lever in its angular movement, said first lever being held by the spring as far as its fully loaded position in one of two end positions corresponding to the switch-on or switch-off position of the movable main switching contact; and a third lever pivotably coupling the first lever to the auxiliary switching pin which is mounted on a second shaft connected to the auxiliary switching pin, said second shaft being guided in slots of the movable main switching contact.

2. The switch assembly defined in claim 1 wherein said first lever, said second lever, said third lever, said spring and said cocking means comprise components of a first elastic spring drive disposed on an outer part of said first shaft outside of said movable main switching contact and on one side thereof, a second elastic spring drive having components substantially identical to the components of said first elastic spring drive being disposed on an opposite outer part of said first shaft outside of said movable main switching contact and on a side thereof opposite said first elastic spring drive.

3. The switch assembly defined in claim 1 wherein said spring takes the form of a tension spring.

4. The switch assembly defined in claim 1 wherein said fully tensioned position of the spring occurs in each of two positions of the movable main switching contact, in each of said positions the distance between the end of the movable main switching contact extending into the isolating space and the other of the electrodes corresponding to the necessary electric strength, said distance being greater than the distance at which the resistance of the compressed insulating gas breaks down under the voltage between said contacts.

5. The switch assembly defined in claim 4 wherein said second position of said movable contact is the same as said first position.

6. The switch assembly defined in claim 1 wherein said cocking means includes a pair of pivotably mounted guide levers disposed in said guide slot for controlling the motion of said guide member and said second lever to load said spring, said guide levers being substantially identical in form and being arranged in a mirrored configuration, said cocking means further including stops in said guide slot for arresting the pivoting motion of said guide levers.

7. The switch assembly defined in claim 1 wherein said cocking means includes a pair of biasing springs attached to respective ones of said guide levers for holding same against respective ones of said stops.

8. The switch assembly defined in claim 1 wherein said arresting means includes a pair of stops connected to said movable contact.

9. The switch assembly defined in claim 1 wherein the switching installation includes a plurality of switching gaps connected in series to one another, said fixed contact and said movable contact defining one of said switching gaps.

* * * * *